United States Patent [19]

Aikman

[11] Patent Number: 4,466,448

[45] Date of Patent: Aug. 21, 1984

[54] TOBACCO SMOKE FILTER

[76] Inventor: Leslie N. Aikman, 3628 Ocean Blvd., Corona Del Mar, Calif. 92625

[21] Appl. No.: 253,902

[22] Filed: Apr. 13, 1981

[51] Int. Cl.[3] ..... A24D 3/04

[52] U.S. Cl. ..... 131/216; 131/339; 131/340; 131/341

[58] Field of Search ..... 131/198 R, 198 A, 336, 131/339, 340, 341, 201, 216, 202, 203, 206

[56] References Cited

U.S. PATENT DOCUMENTS

| | | | |
|---|---|---|---|
| 3,223,091 | 12/1965 | Fassbender | 131/206 |
| 3,232,299 | 2/1966 | Miller | 131/198 R |
| 3,294,095 | 12/1966 | Ackerman | 131/198 R |
| 3,318,316 | 5/1967 | Banderas et al. | 131/339 |
| 3,777,765 | 12/1973 | Yoshinaga | 131/339 |
| 4,109,666 | 8/1978 | Norman | 131/339 |
| 4,116,602 | 9/1978 | Van Hall | 131/340 |
| 4,175,571 | 11/1979 | Swanson | 131/198 |
| 4,253,476 | 3/1981 | Sato | 131/336 |
| 4,344,444 | 8/1982 | Muira et al. | 131/210 |

FOREIGN PATENT DOCUMENTS

| | | | |
|---|---|---|---|
| 1814713 | 7/1969 | Fed. Rep. of Germany | 131/198 R |

*Primary Examiner*—Vincent Millin

*Attorney, Agent, or Firm*—Grover A. Frater

[57] ABSTRACT

Conventional porous labyrinth type filtering is combined with ambient air and conduction of smoke past the filter element in a cigarette holder wherein a selected portion of the tar and nicotine products are to be removed from the cigarette smoke. In its preferred form, a generally cylindrical porous filter element formed with an axial recess opening at one end of the filter is provided with an outwardly extending flange which serves to prevent passage of smoke past the filter when the filter element is fitted into the cylindrical interior of a cigarette holder. The addition of flutes on the exterior surface of the filter element, and of bypass passages formed in the flange, and air inlet openings of the holder itself, provide a unit which can serve as an element of a smoker's withdrawal kit or as a disposable holder for a smoker whose objective is to minimize tar and nicotine intake rather than to withdraw from the smoking habit.

2 Claims, 8 Drawing Figures

TOBACCO SMOKE FILTER

FIELD OF THE INVENTION

This invention relates to improvements in apparatus for removing tars and nicotine compounds from tobacco smoke.

BACKGROUND OF THE INVENTION

It is not the physical task of removing tars and nicotine materials from cigarette smoke that makes filter design difficult. The problem of the filter designer is to create a filter that smokers will use. In addition to the mechanics of filtering, the designer must concern himself with the smoker's motive in purchasing filtering devices, and he must consider such factors as taste, draw, appearance, custom and fashion and, of course, cost.

The filters that are incorporated as part of the cigarette by cigarette manufacturers are not designed to discourage smoking. They are designed, instead, to permit sales promotion advantages that tar and nicotine content of the smoke is low, and to make this possible at minimun cost without any discernable effect to the smoker. As a class, cigarette filters generally employ a labyrinth formed of porous material which entraps solids and semi-solids that are entrained in the smoke. They do little to condense out the more volatile tars, and most do nothing to reduce the passage of carbon monoxide.

At the other end of the scale are the filtering systems of smokers' "withdrawal kits." The more effective forms of these kit devices combine condensation of tars, nicotine and other compounds by ambient cooling air with a very efficient mechanical filter. The kits usually include several filtering units, each of which is effective in removing a different percentage of the harmful materials from cigarette smoke. Cost considerations usually dictate that the same mechanical filter be used in each individual unit of the kit and that effectiveness be controlled as a function only of the volume amount of ambient air that is added to the smoke.

For the smoker who is determined to quit smoking, the well designed withdrawal kit provides an effective means for accomplishing the goal. However, most kit users have, or adopt, as their goal the reduction in the amount of tar elimination of more tar and nicotine than is removed from conventional filtered cigarettes, and to accomplish this without giving up smoking.

While such a smoker demands the "kick" that is provided by the nicotine, the quantity required to provide that kick is determined primarily by the quantity of nicotine that he is accustomed to inhaling. The withdrawal kit user is given a set of holders each which removes progressively more nicotine. After a brief time, following change to the next more effective filter, his body becomes adjusted to a lower nicotine level. The result is that he still experiences a "kick" notwithstanding that his nicotine and tar intake has been reduced. Thus, it is not lack of "kick" that is responsible for the fact that many withdrawal kit users abandon them. Industry experience is that resistance to use of effective filtering may more likely arise because of the amount of inhalation suction, or the change of flow resistance, or draw, during inhalation, does not feel right. In addition, there is resistance to the frequent cleaning that is required in most withdrawal kits. Further, there is also a reluctance in some cultures and some socio-economic groups to be seen using the cigarette holder that is employed in withdrawal kits.

A majority of withdrawal kit users eventually abandon their use because of draw or feel, prejudice against using holders, cost, or the inconvenience of cleaning. Thus, despite the availability of very effective filtering without loss of "kick" or taste, more improvement has been required in the campaign to reduce the harmful effects of smoking.

SUMMARY OF THE INVENTION

It is the purpose of this invention to provide improved tobacco smoke filtering for cigarette smokers and for cigar and pipe smokers as well.

It is a related purpose to provide cigarette filtering structures and techniques that are more acceptable to the producers and sellers of cigarette filtering devices and to cigarette smokers.

It is another object of the invention to make a meaningful contribution to the cause of better health.

These and other objects and advantages of the invention which will hereinafter appear are provided by a structural arrangement that is new in cigarette filtering, and which provides an unexpected result not only because of the basic arrangement but because of inclusion of a number of inventive features The invention combines a porous filter of the cigarette filter class with the addition of smoke quantity control of the withdrawal kits. This techinque is not mere substitution of the cigarette filter type structure for the mechanical filter of withdrawal kits. Ambient air is introduced not to condense the tars, but merely to dilute the smoke. It is not necessary in this new technique to introduce ambient air at a point upstream from the filter. The air may be introduced downstream from the filter to achieve an equivalent effect. One of the difficulties that plagued the now conventional withdrawal kit cigarette holder was that the user sometimes covered the air inlet opening when he held the holder between his fingers. That difficulty is overcome in the invention because a very wide latitude is now permitted in choice of air inlet hole positions.

A number of materials are available for use as a porous filtering material. Many of those materials are sufficiently inexpensive to make it feasible to consider providing a disposable filtering unit. In this connection the invention provides a unique shape for such filter materials which permits them to be used as a flow control elements as well as a disposable filtering unit.

In preferred form, the filter element is formed of rigid material which is very effective in removing solids and liquids that are entrained in the smoke. That is combined, in the preferred embodiment, with an ambient air inlet of size to provide a major reduction in the amount of tar and nicotine products that are permitted to reach the smoker. In addition, the preferred embodiment provides a second form of control of the amount of tar and nicotine, or the "kick," that is furnished to the smoker. That extra measure of control is provided by a bypass passageway in the filter element. The result is a structure that can be packaged effectively either in a cigarette holder of the type that is usually used in withdrawal kits or in a new, small holder so inconspicuous that it looks much like the filter tip of a filter tipped cigarette. The need for a set of holders in a withdrawal kit is avoided. Variation in filter effectiveness is accomplished by a small change in the inexpensive filter unit itself.

A major advantage of the invention is that it makes possible the provision of a small, inconspicuous cigarette holder that remains effective when used with a pack or more of cigarettes, and is sufficiently inexpensive to be practical as a disposable unit. In addition to that, the degree of effectiveness can be varied with ease in the manufacturing process.

In addition to its other advantages, the filter of the invention is structured so that parts of it can be impregnated with menthol and other flavoring material in a way that provides uniform flavor modification of the smoke.

THE DRAWINGS

DETAILED DESCRIPTION

The invention makes use of a filter element of the class that is employed in many of the filters of filtered cigarettes in that it is formed of a material that is porous to permit the passage of smoke but which forms a labyrinth that the smoke must traverse. The direction of flow of the smoke is altered many times so that entrained solids and liquids in the smoke will be thrown into engagement with the filter material there to adhere so that they do not pass through the filter but are filtered out of the smoke. A number of such materials are available and they include crystals, fibers, porous ceramics, and, in a novel development by another, expanded plastics. The preferred form of the invention employs a filtering material which is rigid in the sense that it can be manufactured to have a predefined external surface shape whose dimensions can be rather closely controlled.

The reason why the rigid form is preferred is because it is possible and desirable to utilize the external shape of the filter element in accomplishing flow control of the cigarette smoke to be filtered. While other forms are possible within the invention, the form of the filter illustrated in FIG. 1 is the best form that has been devised.

Figure 1:
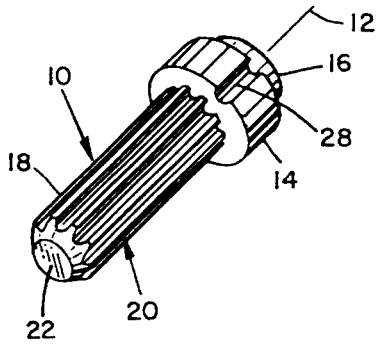
FIG. 1 is an isometric view of a preferred form of tobacco smoke filter according to the invention.

The filter element 10, shown in FIG. 1, is generally symmetrical about a central axis which is represented by line 12 in FIG. 1. The unit is generally cylindrical and it is formed with an outwardly extending cylindrical flange 14 at a point intermediate its ends and closely adjacent to the upstream end 16 of the unit. The downstream portion is formed with a plurality of longitudinally extending flutes two of which are designated 18 and 20, respectively, in the drawing. In this embodiment those flutes are formed by grooves that are arcuately shaped in cross-section, but they could be formed by triangular grooves or grooves having a variety of other shapes. In preferred form, those flutes or grooves are spaced entirely around the periphery of the filter element downstream from the flange 14. The downstream end 22 of the unit is formed as a truncated cone. That shape is one of a number of shapes that could be selected to cooperate with complementally formed conformations within a cigarette holder to the end that the filter will be positioned properly within the holder.

Figure 3:
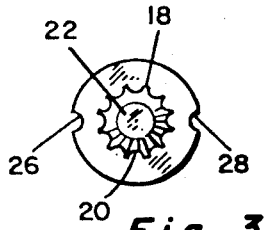
FIG. 3 is a view in elevation of the downstream end of the filter of FIG. 1.
Figure 4:
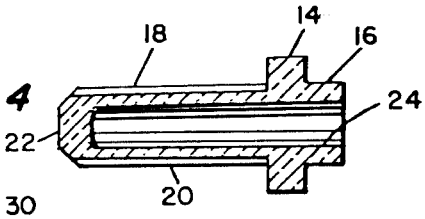
FIG. 4 is a longitudinal, sectional view of the filter element of FIG. 1 taken on line 4—4 of FIG. 2.
Figure 5:
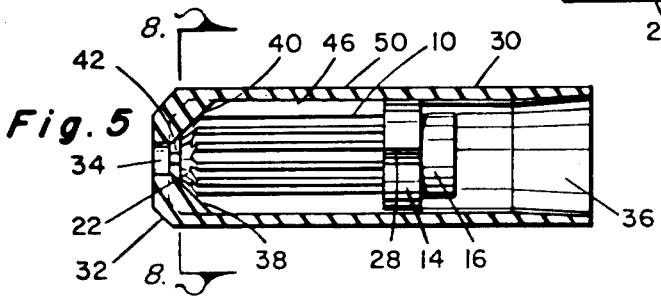
FIG. 5 is a view of a disposable cigarette holder and filter element in which the holder is shown in central longitudinal cross-section.

As best shown in FIGS. 3 and 5, the filter elements is provided with an inner axial bore that is open at the upstream end of the filter but is closed at its downstream end. The wall of that bore is designated by the reference numeral 24.

Figure 2:
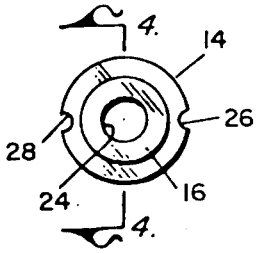
FIG. 2 is a view in elevation of the upstream end of the filter of FIG. 1.

As best shown is FIGS. 1, 2 and 3, the flange portion 14 of the filter element is provided with two diametrically positioned bypass grooves in its outer periphery. These grooves, which are designated 26 and 28, respectively, and are scallop-shaped in this embodiment, permit the flow of smoke past the filter element when the element is assembled in its holder. The number and flow area of those bypass grooves may be adjusted to adjust the quantity of smoke that is permitted to bypass the filter.

Figure 8:
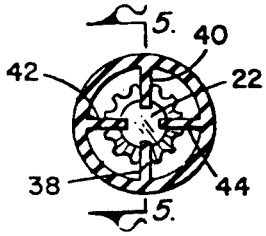
FIG. 8 is a cross-sectional view taken on line 8—8 of FIG. 5.

The filter element 10 is shown positioned within a miniature cigarette holder in FIG. 5. The holder 30 is generally cylindrical and tubular. The unit shown is symmetrical about its central longitudinal axis. The left end, 32 in FIG. 5, is partially closed. It is formed with an end wall which has a central bore 34 through which the user inhales smoke from a cigarette inserted in the right end of the holder where an end portion 36 of the tubing wall is tapered outwardly to accommodate cigarettes of different size. The right end of the holder is formed with four vanes at its interior spaced ninety degrees apart. All four vanes are visible in FIG. 8 where they are designated 38, 40, 42 and 44, respectively. Only three of the vanes are visible in the cross-sectional view of FIG. 5. The upstream edge of those vanes is shaped to complement the conical shape of the downstream end of the filter element 10. During manufacture, the filter element is inserted into the holder at the cigarette receiving end 36 of the latter. The outer periphery of the flange 14 has a diameter corresponding to the inner diameter of the holder 30 so that they have a "pressed" fit. The filter is simply forced into the holder until its conical downstream end is forced against the four positioning vanes. The filter element is shown to occupy that position in FIG. 5 whereby the finished assembly is symetrical about the axial line that is common to the filter and the holder.

The upstream end 16 of the filter serves as a stop for cigarettes of smaller diameter, and it is one of the two parts of the filter that may be impregnated with menthol or other flavoring material when the cigarette taste is to be altered. The flange 14 serves as a barrier to the passage of smoke except that smoke may pass through the two cutouts 26 and 28 in those embodiments in which cutouts are provided. Except for those bypass passages, smoke that is drawn into the holder passes into the opening at the upstream end of the filter that is defined by the inner wall 24. As a consequence of inhalation suction at the holder opening 34, smoke is drawn through the porous, fluted wall of the filter into the annular space 46 that surrounds the downstream end of the filter and from whence it passes past the four vanes 38, 40, 42 and 44 to the exit opening 34.

The fluted wall of the filter is less thick than the flange wall, and it is in that fluted portion that the filtering action occurs. If the composition of the filter element is reasonably uniform, the entire fluted area will turn darker, by degrees, as cigarette smoke is passed through it. The flutes perform a very useful purpose. The inner wall is cylindrical so that the inclusion of the flutes results in a variable wall thickness around the periphery of the fluted portion. Smoke tends to travel initially through those wall portions that are thinner, i.e. in the region of the bottom of the several flutes. As tar and parafins and the like collect in the interstices of the filtering element, the flow is diverted to those portions where the wall thickness is greater. The flow is not necessarily exactly radially outward, but can proceed through those interstices that are not filled with filtrate. The consequence of the fluted design is that the resistance to flow is not changed perceptibly notwithstanding that the smoke of twenty or more cigarettes has been made to flow through the filter.

In this unit the air opening 50 is downstream from the barrier flange 14. Thus the ambient air is introduced into the area at a point downstream from the filtering action. The ambient air is not used to help condense the more volatile tars and nicotine products, and those materials will have passed through the filter in gaseous form. The larger the inlet opening 50, the more ambient air will be drawn into the unit and through the outlet opening 34 as a consequence of inhalation suction. Since the volume that the smoker will inhale is independent of the amount of ambient air, it will be apparent that less smoke will be drawn through the filter, and less filtrate will be caught in the filter when the area of the inlet opening 50 is increased. The effectiveness of the porous, labyrinth type filter 10 exceeds the effectiveness of the differential kinetic energy type filter employed in the conventional smoker's withdrawal kit. The arrangement shown in FIG. 5 is capable of removing just as much tar and nicotine as the smoker's withdrawal kit, notwithstanding that ambient air is not used for cooling and condensing. The unit shown here tends to remove the denser materials more effectively while being less effective with respect to the lighter, more volatile materials. Nonetheless, the filtering action is so efficient that a means must be provided for reducing the quantity of material that is taken from the smoke if the same basic filter structure is to be used in a withdrawal kit whose several elements are designed to remove substantially different proportions of the total tar and nicotine, respectively. In a conventional smoker's withdrawal kit, that is accomplished by changing the size of opening 50. To do that requires a separate holder design for each element of the kit. The lateral opening is relatively difficult and costly to produce. It is much less costly to alter the size and the number of bypass passageways, such as the bypass passageways 26 and 28 because those passages extend longitudinally of the unit rather than transversely. It will be apparent from an examination of FIG. 5 that the invention provides the designer of cigarette smoke filters with an increased number of control points by which he can vary the proportion of cigarette smoke that reaches the user, the proportion of the tars and nicotine that are removed from the smoke, and the suction pressures and, therefore, the feel or draw which the unit presents to the user.

Figure 7:
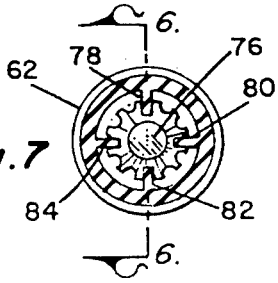
FIG. 7 is a cross-sectional view taken on line 7—7 of FIG. 6.

The length of holder of FIG. 5 is such that it does not have the appearance of a cigarette holder. In fact, when fitted with a cigarette and held between the fingers of the smoker, most of the holder is hidden from view whereby any stigma attached to the use of cigarette holders is dispelled. It is not meant to imply that there is no place for the cigarette holder that includes a filter element. Such a unit is shown in FIG. 7 of the drawing. The holder 60 comprises three sections. The numeral 62 designates the bit and barrel section. The numeral 64 identifies the cigarette receiving end of the holder which is stepped to accommodate cigarettes of different size. That cigarette receiving end is coupled to the barrel of the unit by a coupler 66.

The cigarette receiving end 64 is cup shaped and the bottom of the cup is formed with a large opening 68 through which smoke passes to a cooling chamber 72. Ambient air enters that chamber through an air inlet opening 70. The air is mixed in that chamber which is stepped to reduced diameter as its downstream end. The diameter is reduced so that it will fit within the inner diameter of the upstream end of the barrel portion of bit and barrel section 62. The barrel portion of element 62 and the coupling element 66 and the cigarette receiver 64 are symmetrical about the central axis of those several parts except for the inclusion of the air inlet opening 70 in coupler 66.

The barrel portion of element 62 is provided with an annular recess at its upstream end, and it is in that recess that the filter element 74 is disposed. Except in detail, the filter element 74 is like filter element 10 of FIGS. 1 through 5 and FIG. 8. Filter 74 is symmetrical about its central axis. Its downstream end 76 has the shape of a truncated cone, and it is lodged against a series of vanes that are formed on the inner wall of the bit portion of the member 62 as best shown in FIG. 7 where the vanes are identified with the reference numerals 78, 80, 82 and 84.

Intermediate its ends, the filter element 74 is provided with an outwardly extending flange 86 which corresponds to flange 14 of filter 10. Like flange 14, the flange 86 is formed with a longitudinal smoke bypass passage identified by the reference numeral 88. Downstream from the flange, the outer wall of the filter is fluted. Two of the flutes are visible and are identified by the reference numerals 92 and 94.

In operation, smoke from a cigarette held in the receiving end 64 passes through opening 68 and the mixing chamber 72 into the central opening 96 of the filter element 74 through the opening in the forward end 98 of the filter. The opening 96 does not extend all the way through the filter so that the smoke must flow through the porous filter element in its fluted region to the annular space 100 surrounding the filter from whence it passes past the vanes 78, 80, 82 and 84 to the outlet passage 102 in the bit portion of element 62. The action in this unit is identical to that of the unit of FIG. 5 with the exception that air entering the cooling chamber 72 serves to condense and turn to solids and semi-solids some of the more volatile tars that would simply pass through the filter element of FIG. 5 in gaseous form. As a consequence, a larger proportion of tar and nicotine is removed from the smoke in the filter element 74. Again, the amount of that action and the amount in which it can be afforded by passing smoke around the filter are controlled by adjusting the size of air inlet opening 70 and the size of the bypass passage 88.

It is sometimes helpful to smokers who attempt to overcome the smoking habit to substitute menthol, or some other taste, to mask the diminution in the effect that is produced by inhaling tars and other particulates. Whether for that reason or simply because a smoker prefers the menthol or other taste, it is advantageous to provide a means for adding those flavors to the smoke as it passes through the holder unit.

The material that produces the menthol and other flavors is well known, and is ordinarily added to the tobacco itself. However, it is possible to achieve the same taste effect by impregnating the porous filter elements of the invention with those materials. It is found, however, that impregnating those portions of the filter element in which the active filtering action occurs may result in an increase in the amount of flavor that is added as the quantity of filtrate builds up in the filter. The result is objectionable. However, that difficultly can be overcome by eliminating impregnation of those materials to portions of the filter element in which filtrate is not collected or minimally collected. The preferred arrangement is to impregnate only the upstream end of the filter element with the flavor adding material. In the case of the filter element 10, it is portion 16 that would be impregnated. In the case of filter 74 of FIG. 6, it would be the forward end 98 that is impregnated. And, indeed, while the impregnation is not visible in the drawing, the units there pictured have been impregnated at those positions and also at the extreme downstream end of the unit. It appears that there are certain circumstances in which it is advantageous to limit impregnation to the downstream end of the unit; 22 in the case of filter 10, and 76 in the case of filter 74.

Figure 6:
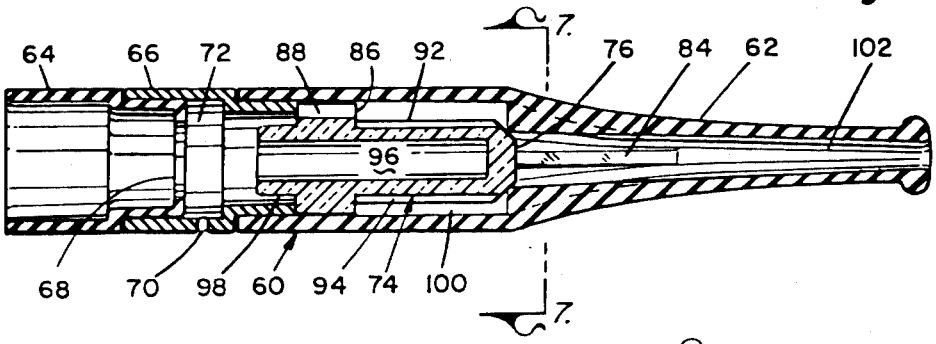
FIG. 6 is a cross-sectional view of a withdrawal kit unit which includes a filter element of the type shown in FIG. 1 and which is taken on a longitudinal center plane through the unit.

It is important for the sake of appearance, ease of manufacture and, more importantly, for proper and uniform filtering action around the entire periphery of the filter element, and also to the addition of flavor to the smoke, that the downstream end of the filtering element be held securely so that its axis is coincident with the axis of the holder and so that flow of smoke and air proceeds over the downstream end of the filter. To this end, a means is provided for centering the downstream end of the filtering element and for ensuring a flow of air and smoke over that downstream end. In FIG. 5, that means is provided by the partially closed end wall 32 and the several vanes 38, 40, 42 and 44. In FIG. 6, that means is provided by the four vanes 78, 80, 82 and 84.

A useful variation of the invention combines the features of the devices shown in FIGS. 5 and 6. The outlet end of the unit of FIG. 5, and its filter element may be flattened to oval shape, much in the manner of a cigar holder. The holder is to extend past and partially around the filter as it does in FIG. 5 to ensure proper flow over the filter end.

Although I have shown and described certain specific embodiments of my invention, I am fully aware that many modifications thereof are possible. My invention, therefore, is not to be restricted except insofar as is necessitated by the prior art.

It will be apparent that the invention is capable of industrial utilization. Units embodying the invention can be manufactured in the form illustrated in the drawing using conventional molding, machining, and other standard industrial processes.

I claim:

1. Apparatus for removing material from the smoke of cigarettes including a cigarette holder having an inlet and an outlet end and means for providing a flowpath for smoke from inlet end to the outlet end, the flowpath having an inner surface;

a porous, labyrinth type filter in that flowpath;

means for conducting a proportionate quantity of unfiltered smoke through said flowpath around said filter;

means for causing a portion of the cigarette smoke traversing said flowpath to pass through said filter and for causing a portion of said smoke to be bypassed around said filter as an incident to inhalation suction at the output end of said holder; and said filter element comprising an elongated element having a central recess opening at one end of the element and a barrier formed at its exterior and extending between said filter element and the inner surface of said flowpath over a selected portion of said filter element whereby a selected portion of flow through said flowpath is confined to flow through said recess.

2. The invention defined in claim 1 which further comprises means for causing a portion of the cigarette smoke traversing said flowpath to pass through said filter and for causing another portion of said smoke to be bypassed around said filter as an incident to inhalation suction at the output end of said holder.

* * * * *